US009457206B2

(12) United States Patent
Kolmes et al.

(10) Patent No.: US 9,457,206 B2
(45) Date of Patent: Oct. 4, 2016

(54) FIRE RESISTANT ANTI-BALLISTIC KNIT FABRIC AND PROTECTIVE ARTICLE AND PROTECTIVE UNDERGARMENT MADE FROM THE SAME

(71) Applicant: Supreme Corporation, Hickory, NC (US)

(72) Inventors: Matthew Kolmes, New York, NY (US); James Threlkeld, Indian Trail, NC (US)

(73) Assignee: Supreme Corporation, Hickory, NC (US)

( * ) Notice: Subject to any disclaimer, the term of this patent is extended or adjusted under 35 U.S.C. 154(b) by 0 days.

(21) Appl. No.: 14/023,977

(22) Filed: Sep. 11, 2013

(65) Prior Publication Data

US 2014/0201892 A1 Jul. 24, 2014

Related U.S. Application Data

(60) Provisional application No. 61/699,445, filed on Sep. 11, 2012.

(51) Int. Cl.

| | |
|---|---|
| ***A62B 17/00*** | (2006.01) |
| ***A41B 11/02*** | (2006.01) |
| ***A41B 9/00*** | (2006.01) |
| ***A41B 11/08*** | (2006.01) |
| ***A41D 1/00*** | (2006.01) |
| ***A41D 1/06*** | (2006.01) |
| ***D04B 1/16*** | (2006.01) |

(52) U.S. Cl.

CPC ..... *A62B 17/003* (2013.01); *A41B 9/00* (2013.01); *A41B 11/02* (2013.01); *A41B 11/08* (2013.01); *A41D 1/00* (2013.01); *A41D 1/06* (2013.01); *D04B 1/16* (2013.01); *Y10T 442/40* (2015.04)

(58) Field of Classification Search

CPC ..... D03D 15/12; A41D 1/00; A41D 3/92; A41D 31/00; A62B 17/00

USPC ..... 2/2.5, 69, 81, 113, 455, 466, 901; 428/920, 921; 442/134, 135, 136, 304, 442/310, 414

See application file for complete search history.

(56) References Cited

U.S. PATENT DOCUMENTS

| | | | |
|---|---|---|---|
| 4,777,789 | A | 10/1988 | Kolmes et al. |
| 4,838,017 | A | 6/1989 | Kolmes et al. |
| 4,936,085 | A | 6/1990 | Kolmes et al. |
| 5,177,948 | A | 1/1993 | Kolmes et al. |
| 5,382,264 | A | 1/1995 | Sharma |
| 5,423,168 | A | 6/1995 | Kolmes et al. |
| 5,500,025 | A | 3/1996 | Sharma |
| 5,628,172 | A | 5/1997 | Kolmes et al. |
| 5,632,137 | A | 5/1997 | Kolmes et al. |
| 5,644,907 | A | 7/1997 | Kolmes et al. |
| 5,655,358 | A | 8/1997 | Kolmes |
| 5,845,476 | A | 12/1998 | Kolmes |
| 6,212,914 | B1 | 4/2001 | Kolmes et al. |
| 6,230,524 | B1 | 5/2001 | Kolmes et al. |
| 6,341,483 | B1 | 1/2002 | Kolmes et al. |
| 6,349,531 | B1 | 2/2002 | Kolmes et al. |
| 6,363,703 | B1 | 4/2002 | Kolmes |
| 6,367,290 | B2 | 4/2002 | Kolmes et al. |
| 6,381,940 | B1 | 5/2002 | Kolmes et al. |
| 6,467,251 | B1 | 10/2002 | Kolmes |
| RE38,136 | E | 6/2003 | Kolmes |
| 6,576,025 | B2 | 6/2003 | Lapierre |
| 7,101,818 | B2 | 9/2006 | Price et al. |
| 7,111,445 | B2 | 9/2006 | Threlkeld et al. |
| 7,178,323 | B2 | 2/2007 | Kolmes et al. |
| 7,214,425 | B2 | 5/2007 | Kolmes et al. |
| 7,264,637 | B2 | 9/2007 | Cardamone et al. |
| 7,749,602 | B2 | 7/2010 | Chu et al. |
| 7,770,372 | B2 | 8/2010 | Kolmes et al. |
| 7,939,686 | B2 | 5/2011 | Threlkeld et al. |
| 8,732,863 | B2 * | 5/2014 | Hines et al. ..... 2/81 |
| 2005/0086924 | A1 | 4/2005 | Kolmes |
| 2006/0088712 | A1 | 4/2006 | Threlkeld et al. |
| 2007/0094761 | A1 | 5/2007 | Kolmes et al. |
| 2007/0099528 | A1 | 5/2007 | Kolmes et al. |
| 2007/0144135 | A1 | 6/2007 | Kolmes et al. |
| 2007/0271965 | A1 | 11/2007 | Kolmes et al. |
| 2009/0019612 | A1 | 1/2009 | Schulein et al. |
| 2009/0301139 | A1 | 12/2009 | Kolmes et al. |
| 2010/0050699 | A1 | 3/2010 | Kolmes et al. |
| 2010/0058812 | A1 | 3/2010 | Schulein et al. |
| 2010/0175430 | A1 | 7/2010 | Garcia et al. |
| 2011/0167545 | A1 | 7/2011 | Garcia et al. |
| 2011/0189914 | A1 | 8/2011 | Krummel |
| 2012/0146784 | A1 | 6/2012 | Hines et al. |

FOREIGN PATENT DOCUMENTS

| | | |
|---|---|---|
| WO | WO 2011/013721 A2 | 11/2011 |
| WO | WO 2011/013721 A3 | 11/2011 |
| WO | WO 2012/016124 A2 | 2/2012 |

OTHER PUBLICATIONS

U.S. Appl. No. 14/023,977, filed Sep. 11, 2013, Kolmes, et al.
International Search Report, Written Opinion and Search History issued May 20, 2014 in PCT/US13/59193.
Intertek. Antimicrobial testing options, Aug. 2009, pp. 1-2, retrieved from the Internet <URL:http://www.wewear.org/assets/1/7/12009august.pdf>.

* cited by examiner

*Primary Examiner* — Arti Singh-Pandey
(74) *Attorney, Agent, or Firm* — Oblon, McClelland, Maier & Neustadt, L.L.P.

(57) ABSTRACT

A knit fabric is provided having a fabric weight of no more than 20 OPSY (ounces per square yard) prepared from a combination of yarns of a fire-resistant rayon yarn, and an aramid yarn; wherein the knit fabric provides a V50 value of at least 600 fps, measured in accordance with MIL-STD-3207, and particularly provides flame resistance properties, antimicrobial properties, high air permeability, and high water vapor transmission, and a garment formed therefrom.

23 Claims, 3 Drawing Sheets

FIRE RESISTANT ANTI-BALLISTIC KNIT FABRIC AND PROTECTIVE ARTICLE AND PROTECTIVE UNDERGARMENT MADE FROM THE SAME

CROSS REFERENCE TO RELATED APPLICATIONS

The present application claims priority to U.S. Provisional Application 61/699,445, filed Sep. 11, 2012, the entire contents of which are hereby incorporated by reference.

BACKGROUND OF THE INVENTION

1. Field of the Invention

The present invention relates to a fire resistant knit fabric that is anti-ballistic and suitable for formation of protective articles of clothing, particularly protective undergarments.

2. Description of the Related Art

In many industries and professions there is a need for protective wear that is fire resistant and anti-ballistic, yet lightweight and comfortable for the wearer. This is particularly the case for military members needing protection from projectiles and burns.

In current military conflicts, it is often the case that a soldier must deal with improvised explosive devices (IED's). Such IED's, upon detonation, often send projectiles such as sand, rock, and metal fragments, outward at speeds up to 600 feet per second (fps). Conventional clothing does not stop these projectiles which can become readily lodged within the flesh of the soldier, causing pain, trauma, disfigurement, and even death.

There is a need for lightweight, fire-resistant and projectile resistant (anti-ballistic) articles, particularly undergarments, which are comfortable, but provide the wearer with protection from both fire and projectiles in battle zones, particularly areas in which IED's are in use.

Ideally, such garments should be flexible, pliable, and soft. Unfortunately, any improvement in the fire resistance and anti-ballistic properties has usually been at the sacrifice of the other properties, usually resulting in bulky, uncomfortable garments.

Accordingly, a lightweight knit article is needed that can provide both fire resistance and anti-ballistic properties.

SUMMARY OF THE INVENTION

One object of the present invention is to provide a knit garment that provides both fire resistance and anti-ballistic properties for the wearer.

A further object of the present invention is to provide such a knit garment that is lightweight and comfortable and useable as a protective undergarment.

These and other objects of the present invention, either individually or in combinations thereof, have been satisfied by the discovery of a fire and ballistic resistant knit fabric, comprising:

a knit fabric having a fabric weight of no more than 20 OPSY (ounces per square yard) prepared from a combination of yarns, comprising:

a fire-resistant rayon yarn, and an aramid yarn;

wherein the knit fabric provides a V50 value of at least 600 fps;

and an article of clothing prepared therefrom.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
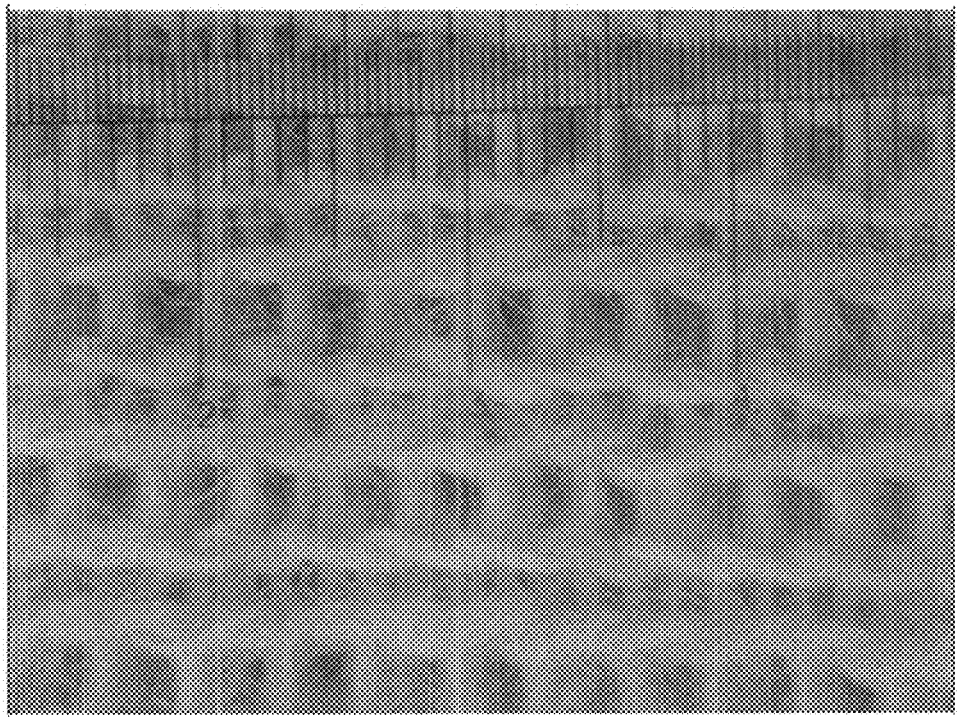
FIG. 1 shows the plaited jersey knit structure of a preferred embodiment of the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consists of a single strand. A "blended yarn" as used herein refers to a yarn that comprises an intimate blend of at least two different types of fibers.

The term "end" as used herein refers to a single yarn ply used in preparation of multi-end yarns. The two or more ends may be put together by twisting together, wrapping a cover wrap around the combined ends or by air-interlacing as described below.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. Nos. 4,777,789, 4,838,017, 4,936,085, 5,177,948, 5,628,172, 5,632,137, 5,644,907, 5,655,358, 5,845,476, 6,212,914, 6,230,524, 6,341,483, 6,349,531, 6,363,703, 6,367,290, and 6,381,940 (collectively, the "Kolmes patents"), the contents of each of which are hereby incorporated by reference.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the relevant portions of which are hereby incorporated by reference.

The present invention relates to a knit fabric that is fire resistant and projectile resistant. In particular, projectile resistance is measured in accordance with the U.S. Department of Defense test standard MIL-STD-3207 (the entire contents of which are incorporated herein by reference), with the present invention fabric providing a $V_{50}$ ballistic limit ($V_{50}$ BL) of at least 600 fps. The $V_{50}$ ballistic limit is defined as the highest velocity of a threat at the specified obliquity at which the probability of (complete) penetration of an armor material is 50 percent. This term is employed as a quantitative measure of armor capability. The present invention knit fabric provides a V50 BL value of at least 600 fps, preferably at least 650 fps, more preferably at least 675 fps, at an obliquity angle of 0° (i.e. normal to the target surface).

Conventional wisdom in the preparation of fabrics having anti-ballistic properties is to provide multiple layers of fabric which are tightly woven, with the stitch directions between adjacent layers being oriented 90 degrees from one another. The resulting multilayer structure provides the anti-ballistic properties by permitting the outer multiple layers to be completely penetrated while slowing the projectile, ultimately stopping the projectile within the stacked layers of fabric.

The present invention fabric, on the other hand, is believed to use a completely different theory of operation. In particular, the present invention fabric is prepared using a plaited jersey knit, which results in a more loosely woven fabric. A preferred embodiment of the plaited jersey knit is represented in FIG. 1.

The inner surface of the fabric (that adjacent to the wearer's skin) comprises a flame resistant rayon yarn, with the outer surface comprising an aramid yarn. When the fabric is impacted by a projectile, the fabric essentially "catches" the projectile by deformation of the fabric at the impact site and surrounding area, much in the manner that a baseball catcher's mitt catches a pitched baseball. This is believed to be due to both the flexibility and pliability of the fabric itself, as well as the ability of the yarn to "borrow" from neighboring stitches to absorb the energy of impact.

The flame resistant rayon yarn used in the present invention can be any desired denier or yarn makeup. Preferably, the rayon is a spun FR rayon which is stretch broken then spun. The rayon is preferably a spun 1.5-2.5 inch staple having individual fiber deniers of 1-3 denier, more preferably a 2 inch staple with the staple fibers having a denier of approximately 2. Most preferably, the FR rayon is a 20/1 to 30/1 FR rayon yarn, most preferably a 26/1 FR rayon yarn. In alternative embodiment, the FR rayon can be a 2 ply yarn (i.e. 26/2 for example). The resulting total denier of the FR rayon portion can be any desired denier, preferably 150-450 denier, most preferably approximately 200 denier (for the 26/1 embodiment).

The aramid yarn used in the present invention fabric can be any aramid. In the case of aramid fibers, suitable aramid filaments formed principally from aromatic polyamide are described in U.S. Pat. No. 3,671,542, which is hereby incorporated by reference. Preferred aramid fiber will have a tenacity of at least about 20 g/d, a tensile modulus of at least about 400 g/d and an energy-to-break at least about 8 joules/g, and particularly preferred aramid fiber will have a tenacity of at least about 20 g/d, a modulus of at least about 480 g/d and an energy-to-break of at least about 20 joules/g. Most preferred aramid fiber will have a tenacity of at least about 20 g/d, a modulus of at least about 900 g/d and an energy-to-break of at least about 30 joules/g. For example, poly(p-phenylene terephthalamide) filaments produced commercially by Dupont Corporation under the trade name of KEVLAR and having moderately high moduli and tenacity values are particularly useful. The aramid yarn of the present invention can have any desired denier, and is preferably a multifilament yarn of total denier from 100-500, more preferably 150-250, most preferably 175-225.

In a most preferred embodiment, the fabric of the present invention is formed from a combination of 26/1 FR rayon and 200 denier poly(p-phenylene terephthalamide) yarn (aramid), which are knitted into a plaited jersey knit fabric, with the FR rayon being most prevalent on one surface of the fabric and the aramid yarn being most prevalent on the other surface of the fabric. The content of each yarn in the resulting fabric is dependent on various factors including, but not limited to, the feel (or hand) desired, and the weight of the garment. Preferably, the fabric contains a FR rayon/aramid ratio of 40/60 to 60/40, more preferably 48/52 to 52/48, most preferably approximately 50/50. This single layer fabric has surprisingly been found to surpass a V50 rating of 600 fps or higher using a 2 grain shot fired from a right circular cylinder "RCC", when measured according to MIL-STD-3207, the entire contents of which are hereby incorporated by reference.

The present invention fabric most preferably provides a combination of antiballistic properties, flame resistance, air permeability, antimicrobial properties and moisture vapor transmission that is unsurpassed by conventional antiballistic or FR fabrics.

For flame resistance, the present invention fabric provides a product that passes the Vertical Flammability test of ASTM D6413 (2008), "Standard Practice for Flame Resistance of Textiles (Vertical Method)", the entire contents of which are hereby incorporated by reference, preferably providing After Flame, and After Glow values of 0 seconds, Char Length of 0 mm, and no Melt/Drip.

The present invention fabric preferably provides air permeability of at least 50 $ft^3$/min, more preferably at least 150 $ft^3$/min, most preferably at least 350 $ft^3$/min, measured in accordance with ASTM D737, 2004 (2008)e2, "Standard Test Method for Air Permeability of Textile Fabrics," the entire contents of which are hereby incorporated by reference.

For moisture vapor transmission, the present invention fabric preferably provides a value of at least 0.1024 lbs/$ft^2$/24 hrs, more preferably at least 0.2048 lbs/$ft^2$/24 hrs, measured in accordance with ASTM E96 2000e1, "Standard Test Method for Water Vapor Transmission of Materials," the entire contents of which are hereby incorporated by reference.

For antimicrobial properties, the present invention preferably provides antimicrobial reduction of at least 95% reduction, more preferably at least 99% reduction. The antimicrobial properties of the present invention can be provided preferably using the antimicrobial treatment described in U.S. Pat. No. 7,939,686, the entire contents of which are incorporated herein by reference.

Other yarns, natural or synthetic, can be present in the present invention fabric as desired, but should avoid jeopardizing the fire resistance and projectile resistance properties.

The present invention fabric can be made into any desired protective garment, including but not limited to, shirts, socks, dickies, undergarments, pants/leggings, etc. In a most preferred embodiment the present invention fabric is formed into a protective undergarment for comfortable wear beneath the soldier's uniform.

EXAMPLES

A single layer fabric was formed by plaited jersey knitting a 26/1 FR rayon yarn, (sold under the tradename LENZING FR by PHARR YARNS) and a 200 denier aramid yarn (sold under the tradename KEVLAR 159 by DuPont). The fabric contained 50.5% FR rayon and 49.5% aramid. The resulting fabric was 9.6 OPSY. The fabric was additionally treated with MICROTEXPUR (available from Supreme Corporation) for to provide antimicrobial properties, in accordance with U.S. Pat. No. 7,939,686.

This fabric was tested for V50 ballistic limit in accordance with MIL-STD-3207 using a 2 grain RCC (right circular cylinder) projectile. The test sample was positioned on an indoor range 9.0 feet from the muzzle of a test barrel to produce zero degree obliquity impacts. Photoelectric infrared screens were positioned at 5.0 and 7.0 feet which, in conjunction with dual elapsed time counters (chronographs), were used to compute projectile velocities 6.0 feet forward of the muzzle. The results obtained are shown in the table below (it is noted that shots 4-6 have no data reported due to a technical problem with the intervolometer velocity machine):

| Shot No. | Powder/ Seating | Time (usec) | Velocity (ft/s) | Vel. Loss (ft/s) | V-Strike (ft/s) | Result | Include in V50 | Footnotes |
|---|---|---|---|---|---|---|---|---|
| 1 | 1.8 | 2672.3 | 748 | 30 | 719 | C | | |
| 2 | 1.7 | 2474.8 | 808 | 32 | 776 | C | | |
| 3 | 1.6 | 3021.3 | 662 | 26 | 636 | P | Y | DEF-3.4 mm |
| 4 | 1.7 | NR | NR | NR | NR | P | | DEF-5.3 mm |
| 5 | 1.7 | NR | NR | NR | NR | P | | DEF-4.3 mm |
| 6 | 1.7 | NR | NR | NR | NR | C | | |
| 7 | 1.7 | 2746 | 728 | 29 | 700 | C | Y | (a) |
| 8 | 1.6 | 2746 | 728 | 29 | 700 | P | Y | DEF-2.9 mm |
| 9 | 1.7 | 3523 | 568 | 22 | 545 | P | | DEF-2.8 mm |
| 10 | 1.8 | 2520 | 794 | 31 | 762 | C | | |
| 11 | 1.7 | 2579 | 775 | 31 | 745 | C | | |
| 12 | 1.6 | 2890 | 692 | 27 | 665 | C | Y | |
| 13 | 1.5 | 2573 | 777 | 31 | 747 | C | | |
| 14 | 1.4 | 3347 | 598 | 24 | 574 | P | | DEF-3.5 mm |
| 15 | 1.5 | 3241 | 617 | 24 | 593 | P | | DEF-4.3 mm |
| 16 | 1.6 | 2568 | 779 | 31 | 748 | C | | |

These results gave a final V50 ballistic limit of 675 fps, summarized as follows:

V50 SUMMARY:
No. Points: 2 & 2
V50: 675
High Partial: 700
Low Complete: 665
Range of Results: 64
Range of Mixed: 35

Figure 2:
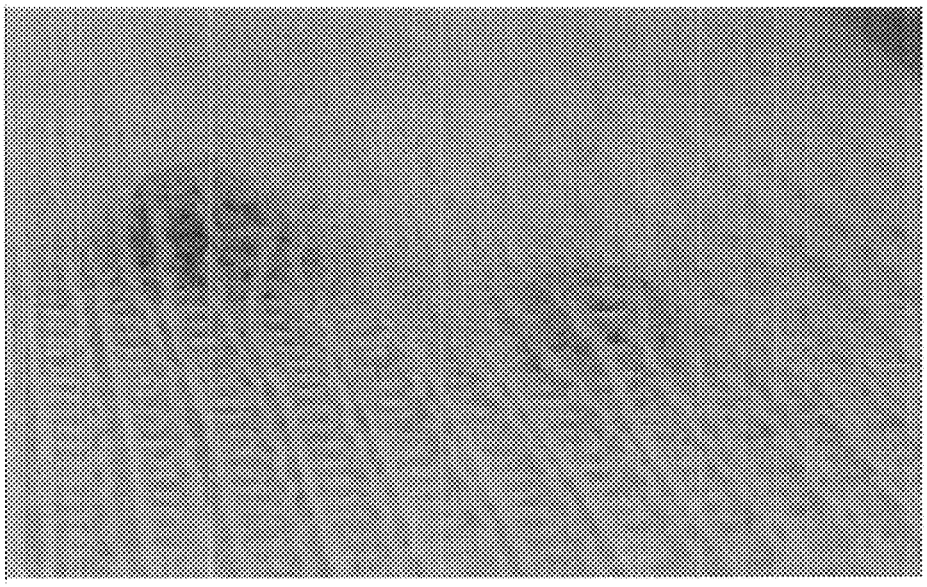
FIG. 2 shows the fabric of the present invention after projectile testing, showing partial penetration of the knit structure.
Figure 3:
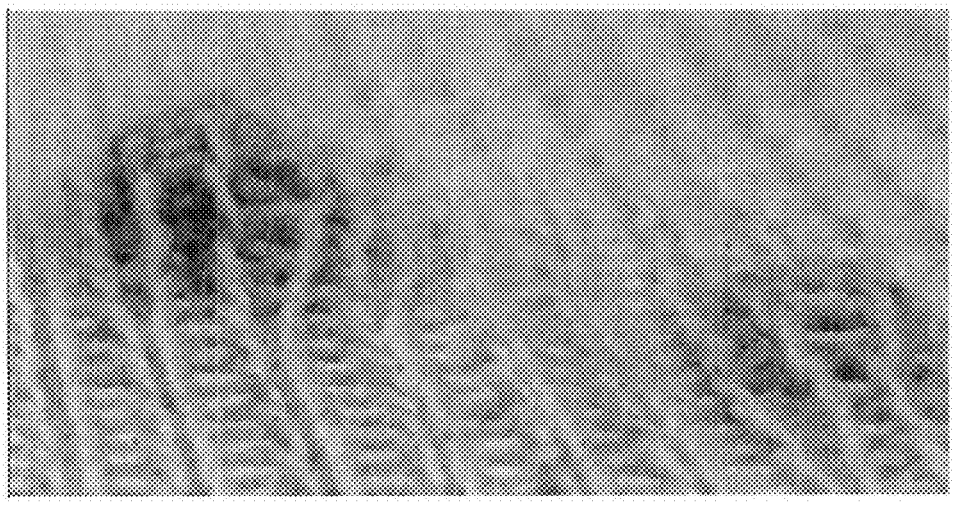
FIG. 3 shows a close up of how the knit structure expanded with the partial penetration to absorb the energy of the projectile and "catch" the projectile.

FIG. 2 shows a photograph of the above embodiment of the present invention fabric after the V50 test. This photograph shows the "dent" caused by the impact but non-penetration (partial penetration) of the projectile. FIG. 3 shows a closeup of such a partial penetration which highlights how the knit structure of the present invention "catches" the projectile while preventing penetration through the fabric.

Accordingly, the present invention fabric surprisingly surpassed the protection needed to protect the wearer from projectiles originating from IED detonations, despite the fact that the present invention fabric is only a single layer of knit fabric.

The fabric was also tested for air permeability in accordance with ASTM D737, water vapor transmission in accordance with ASTM E96, and vertical flammability in accordance with ASTM D6413. The results are shown in the tables below.

Air Permeability:

| Testing Results: | |
|---|---|
| Original State | |
| Sample 1 | 390.000 cfm |
| Sample 2 | 397.000 cfm |
| Sample 3 | 409.000 cfm |
| Sample 4 | 383.000 cfm |
| Sample 5 | 399.000 cfm |
| Sample 6 | 399.000 cfm |
| Sample 7 | 399.000 cfm |
| Sample 8 | 399.000 cfm |
| Sample 9 | 399.000 cfm |
| Sample 10 | 399.000 cfm |
| Average | 395.600 cfm |
| Testing Information: | |
| TextTest Instruments FX 330 Air Permeability Tester III (Software not used) Test Area = 38 $cm^2$; Test Pressure = 125 Pa; Unit of Measure = cfm | |

-continued

| Testing Results: |
|---|
| Test Conditions: 21 ± 2° C. 65 ± 5% RH |
| Test Specimen: single thickness |
| Not enough fabric to perform 10 readings |

Water Vapor Transmission:

| Testing Results: | | | |
|---|---|---|---|
| | Sample 1 | Sample 2 | Sample 3 |
| Start Weight | 273.3 g | 274.05 g | 273.42 g |
| Finish Weight | 262.78 g | 262.77 g | 262.31 g |
| Time Elapsed | 24 hr | 24 hr | 24 hr |
| Area of circle | 0.00636 $m^2$ | 0.00636 $m^2$ | 0.00636 $m^2$ |
| Rate of Water Vapor Transmission | 1654.088 $g/m^2/24$ hr | 1773.585 $g/m^2/24$ hr | 1746.855 $g/m^2/24$ hr |
| Average | 1724.8 $g/m^2/24$ hr | | |
| Standard Deviation | 62.7 | | |

Testing Information:

Procedure B (water method) used
Test Temperature: 23.05° C.
Relative Humidity: 50.08%
Face of fabric exposed to air; Back of fabric exposed to water
Fabric Thickness: 1.414 mm
Circular aluminum cups Vertical Flammability:

| | Afterflame Time | Afterglow Time | Char Length | Melt/Drip? |
|---|---|---|---|---|
| Length Direction | | | | |
| Sample #1: | 0 seconds | 0 seconds | 0 mm | no |
| Sample #2: | 0 seconds | 0 seconds | 0 mm | no |
| Sample #3: | 0 seconds | 0 seconds | 0 mm | no |
| Sample #4: | 0 seconds | 0 seconds | 0 mm | no |
| Sample #5: | 0 seconds | 0 seconds | 0 mm | no |
| Avg: | 0.0 seconds | 0.0 seconds | 0.0 mm | — |
| Width Direction | | | | |
| Sample #1: | 0.0 seconds | 0.0 seconds | 0.0 mm | no |
| Sample #2: | 0.0 seconds | 0.0 seconds | 0.0 mm | no |
| Sample #3: | 0.0 seconds | 0.0 seconds | 0.0 mm | no |
| Sample #4: | 0.0 seconds | 0.0 seconds | 0.0 mm | no |
| Sample #5: | 0.0 seconds | 0.0 seconds | 0.0 mm | no |
| Avg: | 0.0 seconds | 0.0 seconds | 0.0 mm | — |

Testing of antimicrobial properties was performed in accordance with AATCC 100-2004, showing an antimicrobial reduction of 99.29% for *S. aureus* and *E. coli*, as noted below.

Assessment of Antibacterial Finishes on Textile Materials - AATCC 100-2004
Testing Results:

| | Results: cfu/sample | | |
|---|---|---|---|
| 0x | Zero Contact Time | 24 hr Contact Time | Percent Reduction |
| *Staphylococcus aureus* ATCC 6538 | 1.40E+05 | 9.99E+02 | 99.29% |
| *Escherichia coli* ATCC 25922 | 1.40E+05 | 9.99E+02 | 99.29% |

Calculate % reduction to formula 1) 100 (B − A)/B = R; section 11.2
Explanation: the higher the % value the more organism were destroyed; negative values equal an increase in bacterial numbers Testing Information:

*Staphylococcus aureus* ATCC 6538
*Escherichia coli* ATCC 25922
Sample size: 1.0 g
Neutralizer: Letheen Broth w. Tween
Target inoc. Level: (1.0-2.0) × $10^5$ CFU/ml
Wetting agent: 0.05% Triton X -continued Inoculum carrier: Phosphate buffer
Sterilization: autoclave Samples are prepared and enumerated using automatic equipment
Dilution of organism prepared in Phosphate buffer; cultures stored at 5° +/− 2° C.

Obviously, numerous modifications and variations of the present invention are possible in light of the above teachings. It is therefore to be understood that within the scope of the appended claims, the invention may be practiced otherwise than as specifically described herein.

The invention claimed is:

1. A knit fabric having a fabric weight of no more than 20 OPSY (ounces per square yard) prepared from a combination of yarns, comprising:
a fire-resistant rayon yarn, and
an aramid yarn;
wherein the knit fabric is a plaited jersey knit; and
wherein the knit fabric provides a V50 value of at least 600 fps, measured in accordance with MIL-STD-3207.

2. The knit fabric as claimed in claim 1, wherein the fire-resistant rayon yarn and aramid yarn are present in a ratio of rayon/aramid of 40/60 to 60/40.

3. The knit fabric as claimed in claim 2, wherein the ratio of rayon/aramid is from 48/52 to 52/48.

4. The knit fabric as claimed in claim 3, wherein the ratio of rayon/aramid is approximately 50/50.

5. The knit fabric as claimed in claim 4, wherein the ratio of rayon/aramid is 50.5/49.5.

6. The knit fabric as claimed in claim 1, wherein the knit fabric has a fabric weight of no more than 10 OPSY.

7. The knit fabric as claimed in claim 6, wherein the V50 value is at least 675 fps.

8. The knit fabric as claimed in claim 1, wherein the knit fabric provides an air permeability of at least 50 $ft^3$/min, as measured in accordance with ASTM D737.

9. The knit fabric as claimed in claim 8, wherein the V50 value is at least 675 fps.

10. The knit fabric as claimed in claim 1, wherein the knit fabric provides a water vapor transmission value of at least 0.1024 $lbs/ft^2/24$ hrs, as measured in accordance with ASTM E96.

11. The knit fabric as claimed in claim 10, wherein the V50 value is at least 675 fps.

12. The knit fabric as claimed in claim 1, wherein the knit fabric provides an antimicrobial reduction of at least 95%, as measured in accordance with AATCC 100-2004.

13. The knit fabric as claimed in claim 12, wherein the V50 value is at least 675 fps.

14. The knit fabric as claimed in claim 1, wherein the knit fabric provides an air permeability of at least 50 $ft^3$/min, as measured in accordance with ASTM D737, a water vapor transmission value of at least 0.1024 $lbs/ft^2/24$ hrs, as measured in accordance with ASTM E96, and an antimicrobial reduction of at least 95%, as measured in accordance with AATCC 100-2004.

15. The knit fabric as claimed in claim 14, wherein the knit fabric provides an air permeability of at least 350 $ft^3$/min, as measured in accordance with ASTM D737, a water vapor transmission value of at least 0.2048 $lbs/ft^2/24$ hrs, as measured in accordance with ASTM E96, and an antimicrobial reduction of at least 99%, as measured in accordance with AATCC 100-2004.

16. The knit fabric as claimed in claim 15, wherein the V50 value is at least 675 fps.

17. The knit fabric as claimed in claim 14, wherein the V50 value is at least 675 fps.

18. The knit fabric as claimed in claim 1, wherein the knit fabric provides vertical flammability values of After Flame, and After Glow of 0 seconds, Char Length of 0 mm, and no Melt/Drip, as measured in accordance with ASTM D6413.

19. The knit fabric as claimed in claim 18, wherein the V50 value is at least 675 fps.

20. The knit fabric as claimed in claim 1, wherein the V50 value is at least 675 fps.

21. A garment formed from the knit fabric of claim 1.

22. The garment of claim 21, wherein the garment is a member selected from the group consisting of shirts, socks, dickies, undergarments, pants, and leggings.

23. The garment of claim 22, wherein the garment is a protective undergarment.

* * * * *